United States Patent [19]

Males

[11] 4,053,094

[45] Oct. 11, 1977

[54] CARTRIDGE CONTAINING CONTINUOUS WIRE COIL AND PORTABLE DEVICE FOR CUTTING SUCCESSIVE LENGTHS FROM THE WIRE AND DRIVING THE SAME

[75] Inventor: Robert E. Males, Cranston, R.I.

[73] Assignee: Textron, Inc., Providence, R.I.

[21] Appl. No.: 683,816

[22] Filed: May 6, 1976

[51] Int. Cl.[2] ..... B25C 1/04; B65H 17/52; B65H 49/02

[52] U.S. Cl. ..... 227/93; 227/80; 206/409; 242/103; 242/129; 242/138

[58] Field of Search ..... 227/28, 29, 30, 79, 227/80, 93, 95, 136; 221/71, 72, 73, 74, 251; 206/389, 390, 403, 409, 411; 226/62, 64, 65, 66, 67, 68, 137, 141, 151, 167; 242/103, 129, 129.8, 134, 137, 137.1, 138, 141, 146

[56] References Cited

U.S. PATENT DOCUMENTS

| | | | |
|---|---|---|---|
| 2,043,651 | 6/1936 | Boden | 221/74 |
| 2,106,726 | 2/1938 | Draeger | 206/389 |
| 2,161,540 | 6/1939 | Tager | 242/103 |
| 2,547,253 | 4/1951 | Bowers | 242/137.1 |
| 3,133,714 | 5/1964 | Lerner | 242/103 |
| 3,622,062 | 11/1971 | Goode et al. | 227/136 |
| 3,945,551 | 3/1976 | Sato et al. | 227/136 |

*Primary Examiner*—Granville Y. Custer, Jr.
*Attorney, Agent, or Firm*—Cushman, Darby & Cushman

[57] ABSTRACT

A fastener cartridge of the throw-away type including a housing enclosing an elongated continuous wire wound in coil formation on a spool and mounting the spool for rotation about its axis in response to an outward pull on a free end portion of the strand extending outwardly of the housing and a holding pawl within the housing for preventing movement of the strand free end portion into the housing and a cooperating portable power-operated device lockingly securing said cartridge in operative relation thereon having power driven means for cutting off successive lengths from the free end portion of the wire and driving the same into a workpiece. The dimension of the lengths cut off from the wire can be varied within a range as desired by an adjustable power-operated feed pawl which cooperates with the holding pawl of the cartridge.

27 Claims, 14 Drawing Figures

Fig. 4.
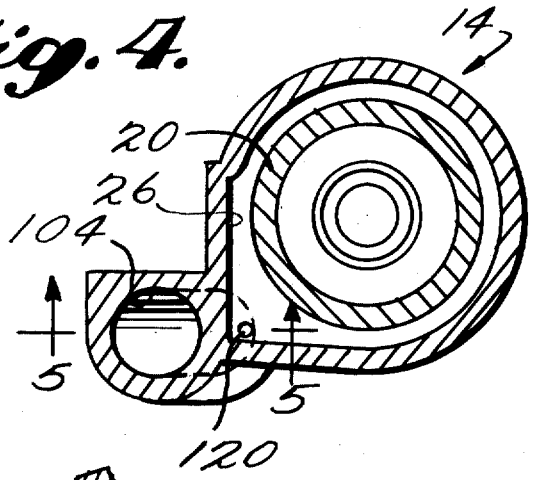
Fig. 6.
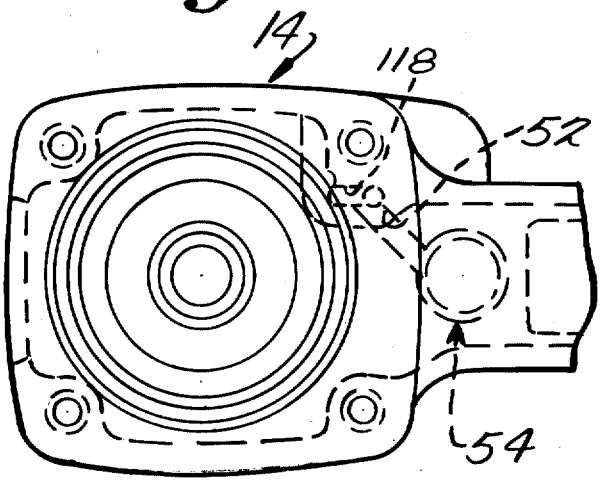
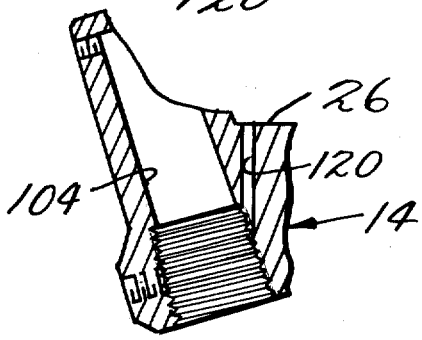
Fig. 5.
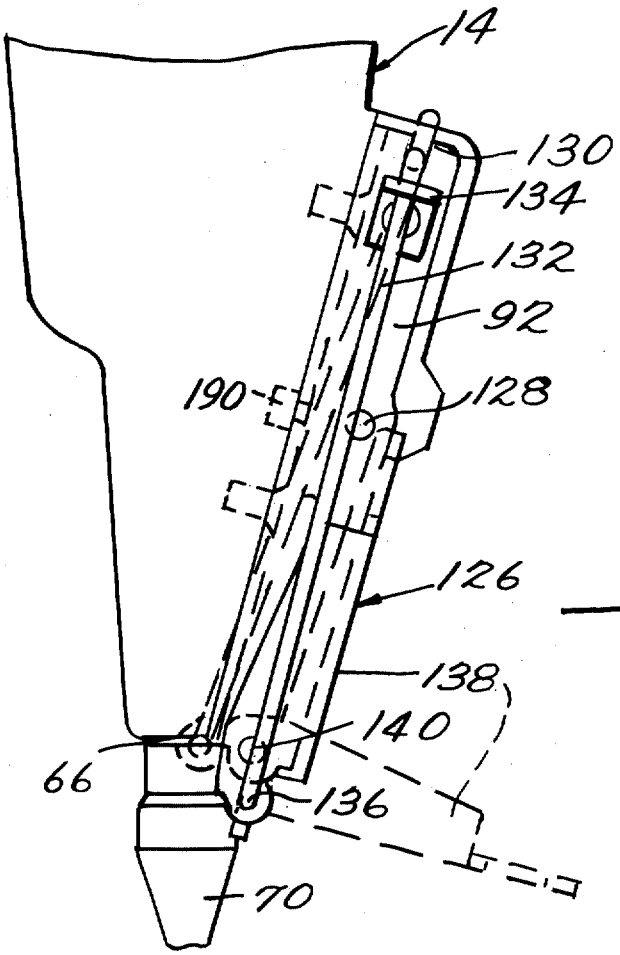
Fig. 7.

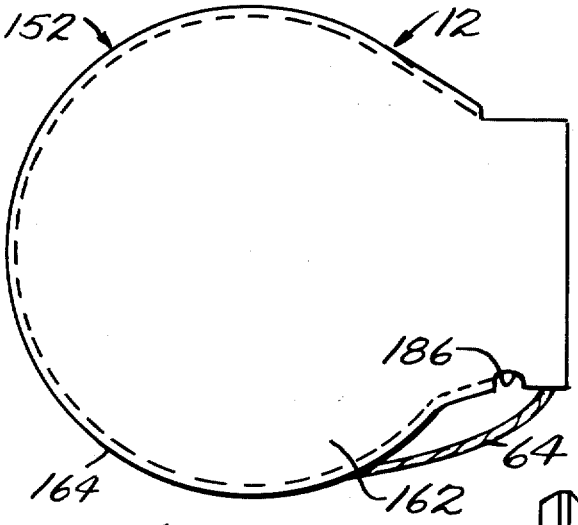
Fig. 9.
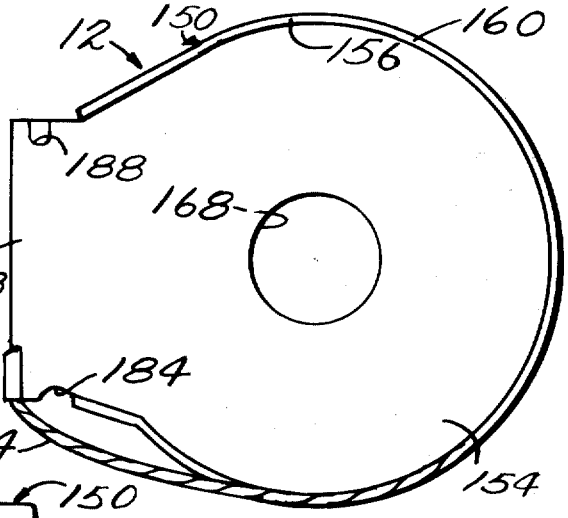
Fig. 10.
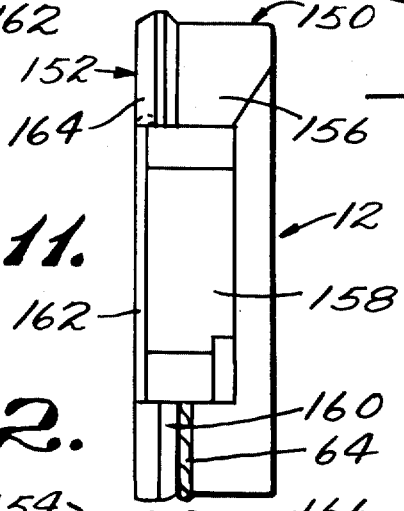
Fig. 11.
Fig. 12.
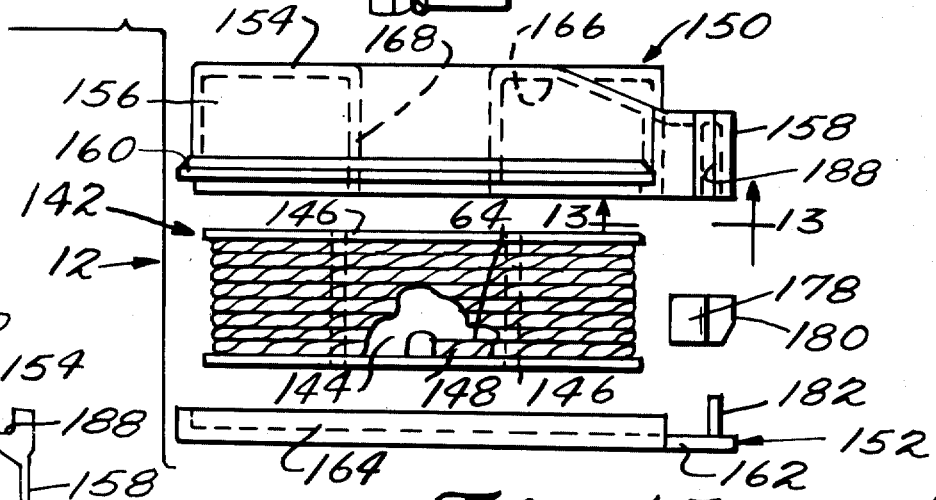
Fig. 14.
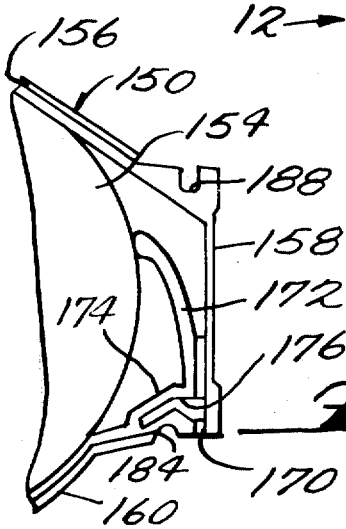
Fig. 13.
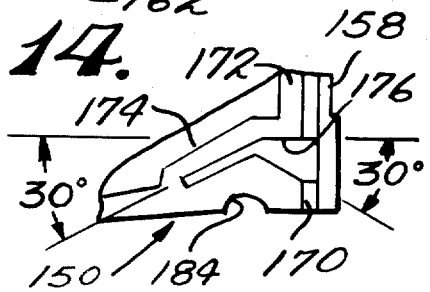

CARTRIDGE CONTAINING CONTINUOUS WIRE COIL AND PORTABLE DEVICE FOR CUTTING SUCCESSIVE LENGTHS FROM THE WIRE AND DRIVING THE SAME

This invention relates to portable powder-operated fastener driving devices and more particularly to improvement in such devices rendering the same operable to drive successive headless nails or pins.

Portable power-operated fastener driving devices for driving small U-shaped staples have been in widespread use for many years. Light duty devices of this type have been available commercially for power operation through compressed air or electricity. Pneumatically-operated fastener driving devices of this type have achieved widespread acceptance in the furniture making industry. The usual application involves the driving of small U-shaped staples for purposes of accomplishing many of the routine securing functions. The convenience and economy of these tools and fasteners have led to the utilization of other types of fasteners in devices of this type for specialized fastening jobs. One example of a specialized fastening job of the type referred to is in the securement of decorative trim, overlays and moldings in furniture making. In such jobs, glue serves as the primary fastening means and the pins serve as a means for effecting securement until the glue takes hold. The effectiveness of such pins is dependent upon their ability to be countersunk into the decorative trim or overlay so as to leave a hole outwardly of the head which is of such small size as to be virtually unnoticeable after the trim or overlay is finished without the necessity of going through a special hole filling procedure. Consequently, it is important that such pins have a construction in which the size of the head is minimized. In general, it can be stated that this requirement has meant that all known pins are effectively headless or are provided with upper striking ends which are of a size generally the same as the cross-section size of their shanks. Where this minimum relationship is adhered to, the countersink hole size is determined by the shank diameter size and hence it becomes desirable to minimize the shank diameter as well.

Insofar as prior art portable power-operated devices have been utilized to drive such pins, it has been necessary heretofore to individually form the pins and package them in sticks similar to the staple sticks used with such devices. A typical package of minimum size pins is a stick of 100 each having a length of ½ inch and shank dimensions of 0.050 × 0.035 inches. It will be appreciated that with individual fasteners of such small size considerable difficulty is encountered in packaging and driving the same. Thus, the necessity to package individual pins in stick form and the necessity to effect successive driving movements by stripping the leading fastener from the stick by a downward blow on the top of the small upper striking surface of each pin have effectively limited the minimum size of the pins available for use in such portable devices to a size which is in excess of that really needed to do the job. The failure to minimize the fastener size results in increased fastener costs and increased downtime for reloading.

An object of the present invention is to provide an improved portable tool and cooperating pin fastener packaging and feed system which makes it possible to minimize the size of the pin fasteners to an optimum size for the job, thus overcoming the disadvantages of excessive fastener costs and downtime for reloading encountered in prior art portable tools and pin fasteners noted above. In accordance with the principles of the present invention this objective is obtained by replacing the usual stick pin package with a package in the form of a coil of wire and replacing the usual tool mechanism for accomplishing the stick stripping action with a mechanism operable to accomplish a sequential cutoff and driving action from the end of the coil of wire. Of further importance is that the aforesaid mechanism preferably is constructed so as to provide the additional function of varying the length of the cut-off end of the wire so as to optimize the pin size for the job from a minimum smaller than heretofore commercially avialable to large sizes where required, without the necessity of changing the fastener package as is now the case with prior art pin stick packages and tools.

It is recognized that there are presently available on the commercial market relatively large stationary fixture type machines capable of receiving a very large coil of wire and of cutting off a variable length from the end of such wire and of driving the cut-off length into decorative trim and overlays. An example of such a machine is identified by the Registered Trademark "AUTO-NAILER," model Apollo-1 (a brochure of the same is filed concurrently with the present application). A machine of this type constitutes production equipment of the type which is permanently installed as a part of an assembly line procedure. (Note, for example, the net weight of from 550 to 620 pounds in the specifications of the brochure.) The machine accepts an initial coil of wire which is identified by the Registered Trademark "THREDLOK." The wire is either of 0.045 inch diameter (19-gage) or of 0.035 inch diameter (21 gage). A new coil of the larger size wire is approximately 16,850 inches long and weighs approximately 5 pounds whereas a new coil of the smaller size wire is approximately 22,386 inches long and weighs approximately 5 pounds. With such weights involved it is apparent that the machine simply is not comparable to the portable power-driven devices of the type herein comtemplated.

In addition to the above-identified known fixture type machines utilizing a coil of wire as a package source for pin fasteners, there is contained in the ancient patent literature at least one disclosure of a shoe making machine of the fixture type embodying a mechanism capable of cutting off and driving successive small lengths from the end of a wire coil. See U.S. Pat. No. 145,754 dated Dec. 23, 1873. A similar mechanism operable upon a paper strand coil is disclosed in U.S. Pat. No. 1,707,404 dated Apr. 2, 1929.

While proposals and commercial capabilities of this type have long been known, portable power-operated devices available to drive small headless nails or pins have all been of the stick package type as stated heretofore. An important aspect of the present invention is the provision of a throw-away type of fastener cartridge containing a continuous elongated strand of fastener material, such as the aforesaid "THREDLOK" wire, wound up in a coil formation of a size readily handled with the portable tool but providing a supply of a number of individual fasteners which greatly exceeds that provided by a multiplicity of pin sticks of the prior art type. For convenience and simplicity a new fastener cartridge includes a free end portion of the strand extending exteriorly from a discharge opening in the housing enclosure thereof and a locking pawl is provided for preventing inward movement of the free end portion of the strand. With this arrangement, the locking pawl not only serves to insure the availability of the free end of the strand to be engaged in initial operative relation with the tool in conjunction with the supply of a new cartridge for the tool, but the locking pawl cooperates with a feed pawl on the tool to effect the feeding action of the strand. The arrangement therefore greatly simplifies the feeding mechanism required on the tool in addition to the procedures required to change fastener cartridges even though such changes will occur substantially less frequently than the change of pin stick packages heretofore required. Moreover, the utilization of such a fastener cartridge enables the operator simply by making a simple adjustment of the feeding mechanisms of the tool to drive pins of any desired length within a predetermined range without changing fastener packages as is now required with pin stick packages of the prior art type.

These and other objects of the present invention will become more apparent during the course of the following detailed description and appended claims.

The invention may best be understood with reference to the accompanying drawings, wherein an illustrative embodiment is shown.

In the drawings:

FIG. 4 is a fragmentary sectional view taken along the line 4—4 of FIG. 2;

FIG. 5 is a fragmentary sectional view taken along the line 5—5 of FIG. 4;

FIG. 6 is a fragmentary top plan view with the top cover removed showing certain air passages in dotted lines;

FIG. 7 is an enlarged fragmentary side elevational view opposite from that shown in FIG. 2 illustrating the cartridge securing mechanism of the device;

FIG. 9 is a front elevational view of the fastener cartridge shown in FIG. 1;

FIG. 10 is a rear elevational view of the cartridge;

FIG. 11 is a side elevational view of the cartridge;

FIG. 12 is a top plan view of the cartridge with the parts thereof shown in exploded relation;

FIG. 13 is an enlarged fragmentary view taken along the line 13—13 of FIG. 12; and FIG. 14 is a further enlarged framentary view of a portion of the structure shown in FIG. 13.

Figures 1, 8:
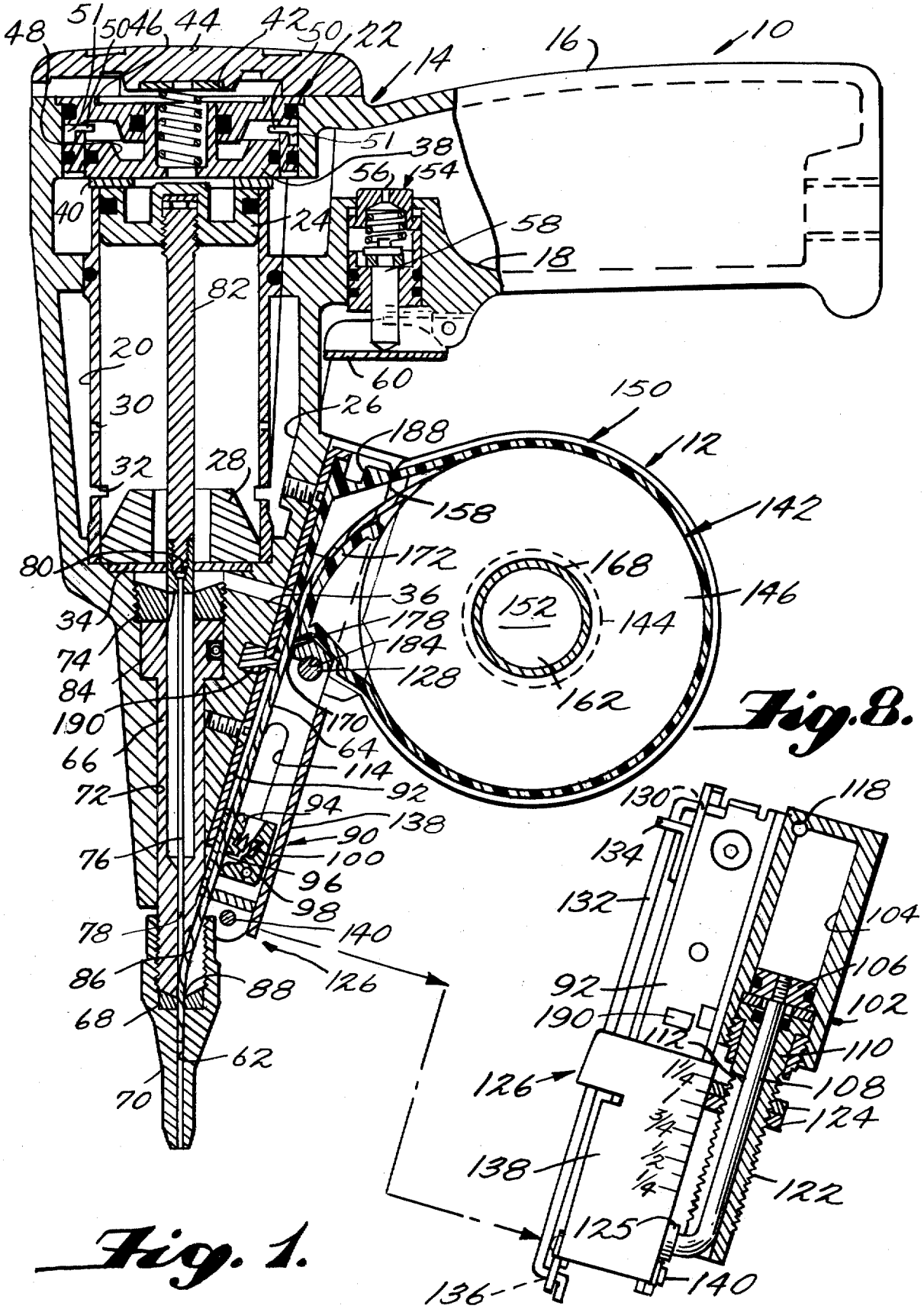
FIG. 1 is a vertical sectional view of a combination portable device and fastener cartridge embodying the principles of the present invention showing the same in cooperating relation.
FIG. 8 is a fragmentary elevational view projected from FIG. 7 along the phantom line indicated with certain parts in section.

Referring now more particularly to FIG. 1 of the drawings, there is shown therein a combination of a portable power-operated fastener driving device, generally indicated at 10, and a cooperating fastener cartridge, generally indicated at 12, which embodies the principles of the present invention. In the preferred embodiment shown, the device 10 or tool is provided with a power operation based upon air under pressure as the power source. It will be readily apparent to those skilled in the art that the principles of the present invention hereinafter enunciated with specific reference to air pressure power operation are equally applicable to electrical power operation both of which are generally known in prior art portable fastener driving device. With the above in mind, it will be appreciated that the device 10 embodies certain components per se of known air pressure actuated devices.

As shown, the device 10 includes a housing structure, generally indicated at 14, which is configured similar to the housing structures of known portable air pressure actuated devices. Thus, the housing 14 includes the usual handle portion 16 shaped to be manually grasped by a user for purposes of handling the device 10. The handle portion 16 is hollow and its interior surfaces define an air pressure reservoir 18 to which an air pressure line (not shown) leading from the air pressure source is connected in accordance with usual practice. The reservoir extends from the handle portion 16 of the housing structure 14 in surrouding relatinon to the upper exterior end portion of a cylinder 20. A pilot pressure operated main valve assembly, generally indicated at 22, is carried by the housing structure 14 in a position to control the communication of the air under pressure within the reservoir 18 with the upper interior end of the cylinder 20.

In accordance with usual practice, the communication of air under pressure to the interior of the cylinder is used to move a drive piston 24 slidably sealingly mounted within the cylinder through a drive stroke. The drive piston is movable through a return stroke by a plenum chamber return arrangement which is also known per se in the prior art. As shown, the arrangement includes a plenum pressure chamber 26 within the housing structure 14 surrounding the lower end portion of the cylinder 20. A drive piston engaging bumper 28 is positioned in the interior lower end of the cylinder to be engaged by the drive piston when it reaches the end of its drive stroke. Air pressure inlet openings 30 for the plenum chamber are provided in the cylinder 20 at a position just above the annular piston seal when the drive piston 24 reaches the end of its drive stroke so as to communicate the air under pressure acting on the piston 24 with the plenum chamber 26. Pressure outlet passages 32 for the plenum chamber 26 are formed in the cylinder 20 below the openings 30 so as to communicate the air pressure in the plenum chamber 26 to the lower surface of the drive piston 24 extending outwardly of the engaged bumper 28. A metering disk 34 is mounted below the bumper 28 to provide for control pressure exhaust to a discharge passage 36 also in accordance with known procedures.

The main valve assembly 22 includes a main piston-like member 38 having an annular valve element 40 on its lower portion which engages and closes the upper end of the cylinder when the member 38 is in the position shown in FIG. 1. In this position the hollow interior portion of the member 38 is spaced from a valve element 42 carried beneath a top cover member 44 forming a part of the housing structure 14 so as to communicate the interior of the cylinder above the piston with the atmosphere.

The main valve assembly 22 includes a insert member 46 defining with the member 38 a pilot pressure chamber 48 which when filled with air under pressure acts to bias the member 38 into the position shown in FIG. 1. Pilot air under pressure is supplied to the pilot pressure chamber 48 through a pair of diametrically opposed radial passages 50 in the insert member 46 extending inwardly from a central exterior peripheral groove 51 and a passageway 52 in the housing structure 14 (see FIG. 6) extending from the peripheral groove 51 communicating with passage 50 to a pilot pressure control valve assembly, generally indicated at 54.

In the normal inoperative position of the pilot pressure control valve assembly shown in FIG. 1, pilot air is communicated with passageway 52 through a bleed orifice 56 communicating directly between the reservoir and the passageway 52. The valve assembly 54 includes a vertically reciprocating valve member 58 with a depending stem which extends outwardly of the housing structure in a position to be engaged by a trigger member 60. The valve member 58 in the position shown in FIG. 1 serves to close an exhaust passage along the depending stem.

It will be understood that the trigger member 60 is adapted to be digitally moved from the position shown into an upper actuating position by the user manually grasping the handle portion 16. Other known manual actuating means such as a contact trip may be provided in conjunction with the trigger actuation, if desired. When the trigger is moved into its actuating position, the pilot air pressure within the pilot pressure chamber 48 is dumped to atmosphere, whereupon the reservoir pressure moves member 46 upwardly lifting valve element 40 off of the cylinder end and finally engaging the tubular central portion with the valve element 42. Reservoir pressure thus enters the top of the cylinder to rapidly move the drive piston through its drive stroke. As the piston reaches the end of its drive stroke, the pressure acting on the upper surface flows through openings 30 into plenum chamber 26 where it builds up and enters the lower end of the cylinder through passages 32. When the user digitally releases the trigger member 60, the pilot chamber 48 is again pressurized causing the member 46 to move downwardly away from valve element 42 communicating the cylinder above the piston to atomsphere and finally engaging valve element 40 with the upper end of the cylinder closing off the reservoir pressure therefrom. Since the pressure acting on the upper surface of the piston is rapidly dumped to atmosphere the pressure within the plenum chamber acting on the lower end of the piston will move the latter upwardly through a return stroke back into the position shown in FIG. 1. The return pressure is allowed to dissipate past metering disk 34 into exhaust passage 36. The operation of the air pressure power components thusfar described are generally known and it will be understood that other comparable known components can likewise be utilized in practicing the principles of the present invention as, for example, differential piston return components, etc.

The device 10 of the present invention includes in combination with the components already mentioned a specially constructed drive track 62 of a cross-sectional size which corresponds to the cross-sectional size of the fastener supply provided in the cartridge 12 which is in the form of a continuous elongated strand 64 of fastener material such as metal wire, a preferred embodiment having a construction corresponding to that of the commerically available "THREDLOK" wire (either 19 or 21 gage) heretofore mentioned. The drive 62 is formed by three telescopically mounted nosepiece members 66, 68 and 70. The upper member 66 seats within a shouldered opening 72 formed in the main casting of the housing structure 14 in a position below the metering disk 34. The upper member 66 is retained within the opening 72 by a plug 74 threadedly engaged within the upper end of the opening 72.

The lower end portion of the member 66 extends outwardly of the opening 72 and is telescopically and threadedly engaged within the lower nosepiece member 70. The member 68 constitutes a specially hardened steel insert mounted between the members 66 and 70.

A specially constructed fastener driving element 76 is slidably mounted within the drive track 62 for movement through an operative cycle including a drive stoke and a return stroke by the drive piston 24. As shown, the fastener driving element 76 has a cross-sectional size comparable to that of the drive track 62 and strand 64 and includes a lower strand cutting and driving end 78 and an upper headed end 80. The fastener driving element 76 is mounted with its headed end 80 engaged with the lower end of a piston rod 82. It will be noted that the member 66 and plug 74 are bored to receive the piston rod which serves to stabilize the piston during its drive and return strokes. The lower end of the piston rod 82 is of reduced diameter and exteriorly threaded to receive a cap 84 which engages the headed end 80 and serves to fix the same rigidly with piston rod. This preferred arrangement is desirable in that the size of the actual fastener driving element 76 is minimized so that it can be formed of specially heat-treated steel to withstand the repeated cutting and driving actions to which the end 78 is subjected. While a long service life is contemplated, the arrangement permits simple replacement of the fastener driving element if need be.

It will be noted that the lower end of the upper nosepiece member 66 has a slot or kerf 86 formed in the rear exterior thereof which diverges downwardly and inwardly until it intersects with the drive track 62 intermediate its ends at an angle of approximately 15°. The kerf 86 defines with the coextensive upwardly facing surface of the insert member 68 a feed opening through which the free end portion of the strand 64 is moved to enter the drive track. The upwardly facing surface of the insert member extends downwardly at an angle of approximately 30° into intersection with the adjacent drive track defining surface to form a cutting edge 88 which cooperates with the cutting end 78 of the fastener driving element 76 to shear the strand 64 during the drive stroke thereof as will be more fully explained hereinafter.

The free end portion of the strand 64 is fed through the kerf feed opening 86 past the cutting edge 88 and downwardly into the drive track 62 by a feed pawl assembly, generally indicated at 90. As best shown in FIGS. 1, 7 and 8, the assembly 90 includes a mounting bracket 92 of generally U-shaped cross-sectional configuration suitably fixed to the main casting of the housing structure in a position to extend upwardly and outwardly from the kerf feed opening 86. Mounted within the bracket 92 is a slide member 94 providing a guide channel 96 of a size to receive the strand 64 therethrough. The slide member 94 pivotally carries a pawl member 98 which is resiliently urged, as by a spring 100, to engage the strand extending through guide channel 96 in such a way that upward movement of the strand is prohibited whereas downward movement relative to the pawl and slide members can take place.

The slide member 94 of the feed pawl assembly 90 is moved through successive operative cycles, each of which includes a feed stroke and a return stroke by an air pressure power-operated actuator assembly, generally indicated at 102. As best shown in FIGS. 1–5 and 8, the assembly 102 includes a cylinder 104 formed in the main casting of the housing structure 14 at a position alongside the bracket 92. Slidably mounted within the cylinder 104 is a piston 106 which is connected to one end of a piston rod 108. The piston rod 108 extends downwardly through an elongated shouldered plug member 110 closing the lower end of the cylinder. The member 110 is formed with a slot 112 which communicates with the central bore therein receiving the piston rod 108, the lower end portion of which is bent at right angles to extend through the slot 112 and a registering slot 114 formed in the adjacent wall of the mounting bracket 92. The extremity of the bent end portion of the piston rod is suitably fixedly connected to the slide member 94 of the feed pawl assembly 90. In this way, the slide member 94 of the feed pawl assembly 90 is directly connected to the acutator piston 106 by the piston rod so that it will be moved in response to the movement of the piston within the cylinder 104.

Figure 3:
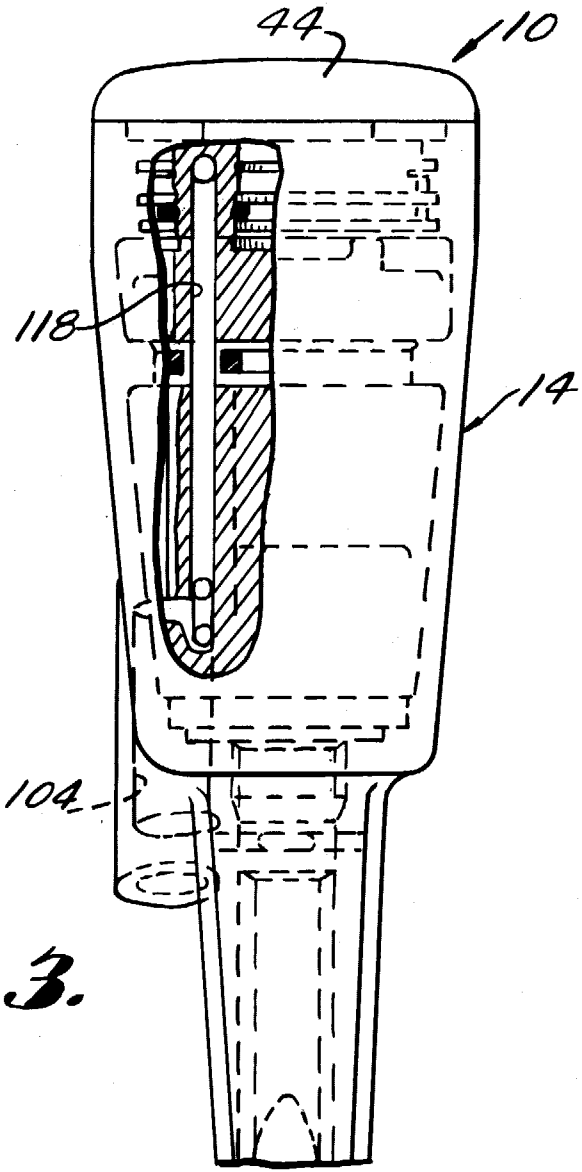
FIG. 3 is a fragmentary front elevational view similar to FIG. 2.
Figure 2:
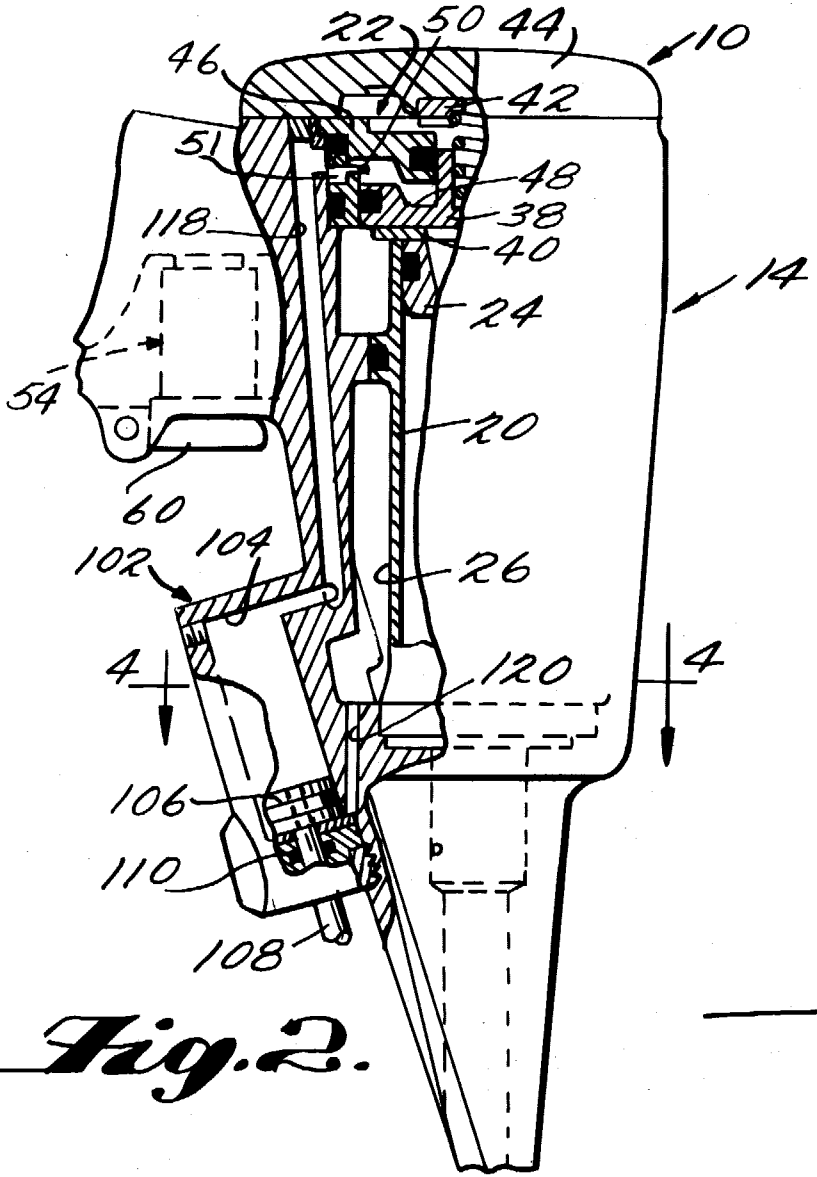
FIG. 2 is a fragmentary side elevational view of the device with certain parts removed and others broken away for purposes of clearer illustration.

The movement of the piston is effected through controlled air under pressure from the system previously described. The feed stroke of the piston is effected by directing air under pressure into the upper end of the cylinder 104 to act on the upper surface of the piston 106 and move the same downwardly through a feed stroke into the position shown in FIG. 8. This air under pressure is preferably obtained from the pilot pressure chamber 48. As best shown in FIGS. 1 and 2, it will be noted that the peripheral groove 51 and radial passages 50 formed in the insert member 46 serve to communicate the pilot pressure chamber 48 to one end of a passageway 118 formed in the main casting of the housing structure 14. As best shown in FIGS. 2 and 3, the passageway 118 extends downwardly and then outwardly into communication with the upper end of the cylinder 104.

Air under pressure to move the actuator piston 106 through a return stroke is preferably obtained from the return plenum chamber 26. As best shown in FIGS. 2, 4 and 5, the portion of the plenum chamber 26 adjacent the cylinder 104 is enlarged and a passage 120 is drilled in the adjacent main casting of the housing structure 14 which extends directly from the enlargement of the plenum chamber 26 to the lower end of the cylinder 104 therebelow.

As previously indicated, an important feature of the present invention is that it is possible by merely adjusting the length of the feed stroke of the actuator assembly 102 and the feed pawl assembly 90 to render the device capable of driving lengths from the free end portion of the strand 64 which are of any desired dimension within a predetermined range. Moreover, this capability can be achieved quite simply in a preferred form by merely providing exterior threads 122 on the plug member 110 and threadly engaging thereon a pair of adjacent stop nuts 124. As best shown in FIG. 8, it can be seen that the lower stop nut 124 will be retained in a position by the upper stop nut 124 to be engaged by a bumper sleeve 125 on the bent end of the piston rod 108 during the return stroke thereof, such engagement thus determining the end of the return stroke and hence the beginning of the feed stroke. Since the end of the feed stroke is fixed by virtue of the engagement of the piston with the adjacent end of the plug, the determination of the position of the beginning of the feed stroke will determine the length of the feed stroke and hence the length of the free end portion of the strand fed past the cutting edge 88 and into the drive track 62.

The device 10 includes one further essential component in the form of a locking assembly, generally indicated at 126, for releasably securing the cartridge assembly 12 in operative relation on the housing structure 14. The preferred embodiment of the locking assembly 126, as shown, is attached to the mounting bracket 92 previously described, and includes a lower fixed mounting rod 128 extending between the legs of the U-shaped section of the bracket 92. The upper end of the bracket leg disposed outwardly of the actuator assembly 102 is formed with an upwardly opening slot 130 for receiving the bent end of a movable locking rod 132. The rod 132 extends downwardly from its bent end through an apertured angle iron 134 and has its opposite lower end bent and pivotally mounted within an opening 136 formed in a locking rod moving member 138 of channel configuration. The member 138 includes legs which embrace the legs of the mounting bracket 92 and a pivot pin 140 serves to pivotally mount the member 138 on the bracket along an axis adjacent the lower end portions of both.

With reference to FIG. 8, it will be noted that when the channel member 138 is disposed in its operative locking position, the outer flat surface thereof provides a convenient and appropriate place to imprint indicia indicating the strand length corresponding to the position of the stop nuts along the indicia.

The feed pawl assembly 90 includes a single feed pawl member 98 is operable to effect a feeding movement of the strand 64 so long as there is provided a locking or holding pawl which acts on the strand 64 to hold the same against the feed pawl member during its return stroke. As previously indicated, in order to simplify the feeding mechanism provided by the device 10 and to make the new strand insertion procedure much easier, the holding pawl function is embodied in the cartridge 12 where it can additionally serve to maintain the initial free end portion of the strand outwardly of the cartridge enclosure for such initial insertion.

Referring now more particularly to FIGS. 1 and 9–14, a preferred embodiment of the cartridge 12 is shown therein which includes the strand 64 as aforesaid. It will be understood that the "THREDLOK" type wire is a preferred stand since its periphery has a threaded configuration quite similar to a conventional screw nail so as to provide a somewhat enhanced holding power as compared with a smooth cylindrical periphery. It will be understood, however, that the present invention contemplates such a strand, as well as other known configurations and materials.

The strand 64 is contained within the cartridge 12 as an elongated continuous strand wound up in coil formation with a free end portion thereof extending outwardly. Preferably, the coil formation of the strand 64 is supplied by winding the strand about a spool, generally indicated at 142. As best shown in FIG. 12, the spool 142 is preferably molded in one piece of a suitable inexpensive plastic material to include a hollow cylindrical hub 144 having guide flanges 146 extending radially outwardly from opposite ends thereof.

To aid in winding the strand 64 on the spool and to positively control the trailing end portion of the strand so that it will not be fed into the drive track when the strand is depleted in use to become jammed or lost therein, the trailing end of the strand is suitably fixed to the spool. As shown in a lug 148 is formed integrally on the hub 144 which is apertured to receive the trailing end of the strand. As best shown in FIG. 12, the end of the strand is anchored to the spool simply by extending the end through the apertured lug and bending it upwardly.

The cartridge 12 includes a housing structure, which, in the preferred embodiment shown, is formed of two parts 150 and 152. Each housing part is preferably molded of a suitable plastic material. One of the parts 150 is generally cup-shaped, while the other part 152 is generally of lid configuration. The part 150 thus includes an apertured disk-shaped side wall 154 having an exterior peripheral wall 156 extending from the outer edge thereof substantially throughout except for a forwardly extending enlargement, indicated at 158. An abutment flange 160 is formed along the peripheral wall 156. The lid-type housing part 152 includes a disk-shaped side wall 162 and a peripheral abutment flange 164 which engages over the peripheral wall 156 in abutting relation with the flange 160 when the parts are assembled.

As assembled, the housing parts 150 and 152 provide an enclosed annular space 166 for receiving the strand 64 in coil formation. The strand 64 as wound in coil formation about the spool 142 is mounted within the space 166 provided by the housing parts for rotational movement about the axis of the coil. To this end the housing part 150 has an integral hollow cylindrical hub portion 168 extending from the interior peripheral edge of the side wall 154 in parallel relation to the peripheral wall 156. It will be understood that the hub 144 of the spool 142 has an interior cylindrical configuration of the size to slidably mate with the exterior cylindrical configuration of the hub portion 168 to accomplish the rotational mounting.

The enlargement 158 of the housing part 150 provides an outlet opening 170 through which an initial free end section of the strand 64 extends. As best shown in FIGS. 9 and 10, a free end portion of this section is initially maintained outwardly of the opening 170 and cartridge housing. The portion of this section within the cartridge housing extends tangentially from the coil formation and is guided to the outlet opening 170 by a curved inner wall 172 formed on the enlargement 158. The inner wall 172 terminates in spaced relation to the outlet opening and joins with a short angular inner wall 174 to define with the adjacent peripheral wall of the enlargement 158 a holding pawl receiving socket 176.

The holding pawl function is provided by a simple angularly bent thin plate of spring steel 178 disposed within the socket 176. As best shown in FIG. 1, the outer bent portion of the pawl plate 178 fits closely within a socket portion which extends at an angle of approximately 60° from the longitudinal axis of the strand 64 disposed within the guide surfaces of the wall 172 and the opening 170. The outer bent portion of the pawl plate 178 extends at an angle of slightly less than 120° from the inner portion and is disposed within the remainder of the socket 176 so that it can flex or move therein with a swinging action. As best shown in FIG. 12, the inner portion of the pawl plate 178 has a strand engaging edge 180 operable to permit passage of the strand thereby when moved relative thereto in a longitudinal direction outwardly of the opening 170. Any attempt to move the strand inwardly in the opposite direction will result in the edge 180 engaging the strand periphery and being flexed into the metal of the strand until further movement is positively prevented.

As shown in FIG. 12, the lid type housing 152 includes an integral lug 182 which serves to retain the pawl plate in a proper lateral operative position within the socket 176.

The manner in which the various components of the cartridge 12 are assembled is believed apparent from the above discussion. Briefly, the spool 142 with a strand 64 in coil formation is moved laterally into the housing part 150 with the aforesaid free end section disposed with an intermediate portion in guided relation to the guide surfaces provided by the inner wall 172 and adjacent interior surfaces of the enlargement 158 and free end portion disposed outwardly of the opening 170. Next, the pawl plate 178 is moved laterally into the pawl socket 176 and finally the lid-type housing part 152 is moved laterally into enclosing cooperative relation with part 150. Preferably, the housing parts 150 and 152 are sealed together, as by sonic welding, to permanently enclose the strand coil formation and therefore prevent opening access to the spool. Access to the interior of the cartridge is not necessary or considered desirable as no advantages are afforded thereby while possible disadvantages may otherwise come into being. In its self-contained form, the free end portion of the strand 64 extending outwardly of the opening 170 is simply bent back along the peripheral wall 156 as shown in FIGS. 9–11.

Finally, it will be noted that the cartridge is provided with exterior access surface for engagement by the locking assembly of the tool to secure the cartridge in operative position thereon, as shown in FIG. 1. These surfaces include registering semi-cylindrical recess surfaces 184 and 186 extending along the lower portion of the enlargement 158 and adjacent portion of the part 152 and a locking pin receiving slot 188 formed in the upper end of the enlargement 158.

To mount the cartridge 12 in operative relation on the device 10, the lock moving member 138 is moved downwardly from the solid line position shown in FIG. 7 into the dotted line position. It will be noted that the pivotal connection between the locking rod and member 138, which is about the axis of the pin 140, provides an over-center toggle movement for the upper locking end of the rod 132. With the member 138 in its open position, as shown in dotted lines in FIG. 7, the cartridge 12 is grasped by the user and the free end portions of the strand 64 are bent outwardly from the assembled position shown in FIGS. 9 and 10 to a generally assembled position shown in FIGS. 9 and 10 to a generally tangential relationship with respect to the outlet opening 170. The free end is then fed through the guide opening 96 past the pawl member 98, through the kerf 86, past the cutting edge 88 and into the drive track 62. The enlargmement 158 of the cartridge is then moved into engagement with the mounting bracket 92 at a position above the fixed mounting rod 128 and then moved downardly until the recess surfaces 184 and 186 engage the upper periphery of the fixed mounting pin or rod 128. Next the member 138 is swung upwardly from the dotted line releasing position shown in FIG. 7 into the solid line locking position. As indicated previously, this moves the upper end of the locking rod 132 downwardly with an over-center toggle action until it engages within the slot 188 provided by the cartridge housing part 150. The rearward surface of the slot 188 has an inclination of about 8° so that the cartrige is wedged forwardly into engagement as the locking rod is moved downwardly therein into its final locking position. In this way the cartridge is now secured in operative relation on the housing structure 14 of the device 10.

It will also be noted that a guide bottom 190 is mounted in the mounting bracket 92 in outwardly extending relation in a position to be engaged by the strand adjacent to the cartridge opening 170 in opposed relation to the pawl 178. The guide bottom relieves the wear on the housing walls engaged by the strand during pull out so as to insure engagement of the holding pawl at all times.

The device 10 is now ready to be used and it will be noted that when the trigger 60 is digitally moved by the user manually grasping the handle portion 16 of the device, the pivot valve assembly 54 will function to dump the pilot pressure from the pilot pressure chamber 48 which permits the member 38 of the main valve assembly 22 to move upwardly opening valve element 40 and closing valve element 42. Reservoir pressure therefore acts upon the upper surface of the drive piston 24 to move the same downwardly within the cylinder 20 through a drive stroke. The fastener driving element 76 is carried by the piston for movement therewith so that during its corresponding drive stroke, the cutting end 78 thereof will initially engage the portion of the strand 64 bent across the cutting edge 88 to sever the same with a shearing action between the cutting end 78 and cutting edge 88. As the fastener driving element 76 continues to move downwardly in its drive stroke, the end 78 engages the cut-off upper surface of the length of strand 64 disposed below the cutting edge 88 and drives the same downwardly and outwardly of the drive track 62 and into the workpiece.

As the piston reaches the end of the drive stroke, plenum chamber openings 30 are uncovered, permitting the air acting on the piston to enter the plenum chamber 26. This air pressure is communicated through the pressure 120 as shown in FIGS. 2 and 3 to the lower end of the feed actuator assembly 102. As the air pressure enters the lower end of the cylinder 104, piston 106 is moved upwardly carrying with it piston rod 109 and the slide member 94 fixed on the end thereof. Note that the upper end of the cylinder is exhausted through passageway 118, and opening 116 leading to the pilot pressure chamber 48. The extent of the upward movement of the feed piston is controlled by the position of the stop nuts 124 on the threads 122 of the plug member 110. During this return movement, pawl 98 will ride over the surface of the strand 64 and the holding pawl 178 will prevent movement of the strand in an upward direction inwardly of the cartridge opening 170.

With the drive piston 24 in it lowermost position, the operator release the trigger member 60 which permits the pilot value assembly 54 to pressurize the pilot pressure chamber 48 of the main valve 22. Member 38 of the main valve assembly 22 therefore moves downwardly, closing valve element 40 and opening valve element 42. It will also be noted with reference to FIGS. 2 and 3 that when air under pressure is communicated with the pilot pressure chamber 48, this air under pressure is allowed to flow through passage 116, passageway 118, into the upper end of the cylinder 104, thus biasing the drive piston 106 to move through its feed stroke.

It will also be understood that as the valve element 40 closes and the valve element 42 is opened, the air pressure above the piston 24 within the drive cylinder 20 is allowed to exhaust to atmosphere so that the pressure within the plenum chamber 26 acting on the outer lower surface of the piston will serve to move the piston through its return stroke, which in turn moves the fastener driving element 76 through its return stroke. As the lower end 78 of the fastener driving element 76 moves by the kerf opening 86, the end of the strand 64 will move downwardly into the drive track 62 by virtue of the bias on the drive piston 106 as previously indicated. Each stroke of the piston 106 which, as aforesaid, is determined by the position of the adjusting nuts 124, will so determine the dimension of the end of the strand 64 which enters the drive track 62. As previously indicated, at the end of the return stroke of the drive piston 24, the plenum chamber pressure is allowed to dissipate past the metering disk 34 into the discharge outlet 36. In this way the device 10 is now in a condition to start a new cycle of operation.

It thus will be seen that the object of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A portable power-operated device for use with a continuous strand of fastener material for cutting off successive short lengths from the free end portion of said strand and driving the same into a workpiece comprising:

a housing structure including (a) a handle portion adapted to be manually grasped by a user for purposes of handling the device, (b) means defining a drive track of a cross-sectional size generally similar to the cross-sectional size of the strand, said drive track including a discharge end and an opposite end and (c) means defining a feed opening intersecting said drive track intermediate the ends thereof including a surface facing toward the opposite end of the drive track which intersects a drive track defining surface to form a strand cutting edge, feed means mounted on said housing structure for effecting a movement of the strand in a direction toward the free end thereof during a feed movement of said feed means, a fastener driving element having a strand cutting end, said element being slidably mounted in said drive track for movement through drive and return strokes between (a) a strand receiving position wherein said cutting end is spaced from said cutting edge in a direction toward the opposite end of said track whereby a free end portion of said strand may be moved through said feed opening angularly past said cutting edge and into said drive track toward the discharge end thereof into an operative position in response to a feed movement of said feed means, and (b) a fastener driving position wherein said cutting end is adjacent the discharge end of said drive track, power operated means carried by said housing structure for effecting successive cycles of movement of said feed means and said fastener driving element, of which each cycle includes (a) a feed movement of said feed means to move a free end portion of said strand into said operative position, (b) a drive stroke of said fastener driving element to cut off a short length from the free end of said strand by a cooperative shearing action between the cutting end of said fastener driving element and said cutting edge and to drive the cut-off length outwardly of the discharge end of said drive track into a workpiece, and (c) a return stroke of said fastener driving means, and manually actuated means including a trigger carried by said housing structure adjacent said handle portion for digital actuation by a user manually gripping said handle portion for actuating said power operated means.

2. A device as defined in claim 1 including means for varying the extent of the feed movement of said feed means so as to vary the dimension of the strand lengths cut off from the free end portion of the strand and driven by said fastener driving device.

3. A portable power-operated device for use with a cartridge including a housing enclosed therein a continuous strand for fastener material in coil formation for rotational movement about its axis in response to a longitudinal pull on a free end portion thereof extending outwardly of said housing and holding pawl means within said housing for preventing inward movement of the strand free end portion of said device comprising:

a housing structure including (a) a handle portion adapted to be manually grasped by a user for purposes of handing the device, (b) means defining a drive track of a cross-sectional size generally similar to the cross-sectional size of the strand, said drive track including a discharge end and an opposite end and (c) means defining a feed opening intersecting said drive track intermediate the ends thereof including a surface facing toward the opposite end of the drive track, said drive tack defining means including a surface which intersects with the aforesaid surface of said feed opening defining means to form a strand cutting edge, means carried by said housing structure for releasably securing said cartridge in operative relation therein with the free end portion of the strand extending through said feed opening past said cutting edge and into said drive track toward the discharge end thereof, feed pawl means mounted on said housing structure for movement through feed and return strokes between a strand engaging position and a strand releasing position and engageable with a free end portion of the strand for effecting a movement of the strand in a direction toward the free end thereof during a feed stroke of said feed pawl means and enabling the free end portion of the strand to remain immobile by the action of the holidng pawl means of said cartridge during a return stroke of said feed pawl means, a fastener driving element having a strand cutting end, said element being slidably mounted in said drive track for movement through drive and return strokes between (a) a strand receiving position wherein said cutting end is spaced from said cutting edge in a direction toward the opposite end of said drive track whereby the free end portion of said strand may be moved into an operative relation, as aforesaid, in response to a feed stroke of said feed pawl means, and (b) a fastener driving position wherein said cutting end is adjacent the discharge end of said drive track, air pressure operated means carried by said housing structure for effecting successive cycles of movement of said feed pawl means and said fastener driving element each of which includes (a) a feed stroke of said feed pawl means to move a free end portion of said strand into said operative relation, (b) a drive stroke of said fastener driving element to cut off a short length from the free end of said strand by a cooperative shearing action between the cutting end of said fastener driving element and said cutting edge and to drive the cut-off length outwardly of the discharge end of said drive track into a workpiece, (c) a return stroke of said feed pawl means and (d) a return stroke of said fastener driving means, and manually actuated means including a trigger carried by said housing structure adjacent said handle portion for digital actuation by a user manually gripping said handle portion for actuating said power operated means.

4. A portable power-operated device as described in claim 3 wherein said air pressure operated means comprises a pressure reservoir within said handle portion, a drive cylinder within said housing structure, a drive piston slidably mounted within said drive cylinder and connected to move said fastener driving element therewith, a main valve assembly for controlling the communication of air under pressure from said reservoir to said drive cylinder and the exhaust of air under pressure from said cylinder, said main valve assembly having a pilot pressure chamber for operating the same, a pilot pressure valve assembly under the control of said manually actuated means for controlling the pressure within said pilot pressure chamber, a plenum chamber surrounding the lower exterior of said cylinder, inlet opening means for said plenum chamber in said cylinder at a position to communicate the air under pressure acting on said drive piston toward the end of said drive stroke and outlet passage means in said cylinder below said inlet opening means for communicating said plenum chamber pressure beneath said drive piston to effect the return stroke thereof.

5. A device as defined in claim 4 wherein said air pressure operated means includes a feed cylinder in said housing structure, a feed piston slidably mounted within said feed cylinder and operatively connected to move said feed pawl means, one end of said cylinder being communicated with said pilot pressure chamber, the opposite end thereof being communicated with said plenum chamber.

6. A device as defined in claim 5 wherein said feed piston is connected to said feed pawl means by an L-shaped piston rod, an elongated hollow plug extending from said feed cylinder receiving said piston rod therein, said plug having a slot communicating with the hollow interior thereof for accommodating the L-shaped configuration of said piston rod, said plug having exterior screw threads thereon, and a pair of adjustable stop nuts engaged on said threads in any one of a multiplicity of adjusted positions to engage the L-shaped configuration of said piston rod and limit the distance of the feed stroke of said feed pawl means thereto to thereby vary the strand length cut off in accordance with the feed stroke.

7. A device as defined in claim 6 wherein the position of said stop nuts indicates on a scale indicia system carried by said housing structure the dimension of the strand length corresponding thereto.

8. A device as defined in claim 7 wherein said housing structure includes a nosepiece assembly containing the means defining said drive track, said nosepiece assembly including a lower nosepiece member having an insert member of hardened steel therein, said insert member containing the surfaces defining said cutting edge.

9. A device as defined in claim 8 wherein said fastener driving element is formed of hardened steel with an enlarged end opposite said cutting end, a piston rod detachably fixed at one end to said drive piston and extending therefrom, and means for detachably fixedly connecting the enlarged end of said fastener driving device with the opposite end of said piston rod.

10. A device as defined in claim 9 wherein said cartridge securing means includes a fixed mounting rod and a movable locking rod forming a part of a toggle linkage, said locking rod having a bent locking end movable toward said fixed rod into a locking position spaced therefrom and away from said fixed rod into a releasing position.

11. A device as defined in claim 3 including means for varying the extent of the feed stroke of said feed pawl means within a predetermined range to thereby vary the dimension of the strand length cut off within a predetermined range.

12. A device as defined in claim 3 wherein said housing structure includes a nosepiece assembly containing the means defining said drive track, said nosepiece assembly including a lower nosepiece member having an insert member of hardened steel therein, said insert member containing the surfaces defining said cutting edge.

13. A device as defined in claim 12 wherein said fastener driving element is formed of hardened steel with an enlarged end opposite said cutting end, a piston rod detachably fixed at one end to said drive piston and extending therefrom, and means for detachably fixedly connecting the enlarged end of said fastener driving device with the opposite end of said piston rod.

14. A device as defined in claim 3 wherein said cartridge securing means includes a fixed mounting rod and a movable locking rod forming a part of a toggle linkage, said locking rod having a bent locking end movable toward said fixed rod into a locking position spaced therefrom and away from said fixed rod into a releasing position.

15. In combination, a fastener cartridge and a portable air pressure operated fastener driving device, said cartridge comprising:

a continuous elongated strand of fastener material wound in a coil formation with a free end section thereof extending outwardly from said coil formation, a cartridge housing structure including (a) means defining an annular space receiving said coil formation therein, (b) means defining an outlet opening through which said free end section extends with a free end portion of said free end section disposed outwardly of said cartridge housing structure and an intermediate portion of said free end section disposed inwardly of said cartridge housing structure between said outlet opening and said annular space, (c) means defining guide surfaces engaging said intermediate portion of said free end section between said outlet opening and said annular space, (d) means mounting said coil formation within said annular space for rotational movement about the axis thereof in response to a longitudinal pull on said free end portion, and (e) means defining exterior access surfaces cooperable with securing means for mounting said cartridge housing structure in operative relation on the portable powder operated fastener driving device, and holding pawl means movably carried by said housing structure adjacent said guide surfaces disposed in cooperating engagement with the intermediate strand portion engaged with said guide surfaces for preventing a longitudinal movement of said free end portion in a direction inwardly of said outlet opening but permitting a longitudinal movement of said intermediate portion outwardly of said oulet opening in response to a longitudinal pull on said free end portion as aforesaid, a tool housing structure including (a) a handle portion adapted to be manually grasped by a user for purposes of handling the device, (b) means defining a drive track of a cross-sectional size generally similar to the cross-sectional size of the strand, said drive track including a discharge end and an opposite end and (c) means defining a feed opening intersecting said drive track intermediate the ends thereof including a surface facing toward the opposite end of the drive track, said drive track defining means including a surface which intersects with the aforesaid surface of said feed opening defining means to form a strand cutting edge, means carried by said tool housing structure engaging said exterior access surfaces for releasably securing said cartridge in operative relation therein with the free end portion of the strand extending through said feed opening past said cutting edge and into said drive track toward the discharge end thereof, feed pawl means mounted one said tool housing structure for movement through feed and return strokes between a strand engaging position and a strand releasing position and engageable with a free end portion of the strand for effecting a movement of the strand in a direction toward the free end thereof during a feed stroke of said feed pawl means and enabling the free end portion of the strand to remain immobile by the action of said holding pawl means of said cartridge during a return stroke of said feed pawl means, a fastener driving element having a strand cutting end, said element being slidably mounted in said drive track for movement through drive and return strokes between (a) a strand receiving position wherein said cutting end is spaced from said cutting edge whereby the free end portion of said strand may be moved into an operative relation, as aforesaid, in response to a feed stroke of said feed pawl means, and (b) a fastener driving position wherein said cutting end is adjacent the discharge end of said drive track, air pressure operated means carried by said tool housing structure for effecting successive cycles of movement of said feed pawl means and said fastener driving element each of which includes (a) a feed stroke of said feed pawl means to move a free end portion of said strand into said operative relation, (b) a drive stroke of said fastener driving element to cut off a short length from the free end of said strand by a cooperative shearing action between the cutting end of said fastener driving element and said cutting edge and to drive the cut-off length outwardly of the discharge end of said drive track into a workpiece, (c) a return stroke of said feed pawl means and (d) a return stroke of said fastener driving meas, and manually actuated means including a trigger carried by said housing structure adjacent said handle portion for digital actuation by a user manually gripping said handle portion for actuating said power operated means.

16. A disposable fastener cartridge for use with a portable power operated fastener driving device comprising:

1. a spool formed of plastic material including a hub portion and flange means extending radially outwardly from said hub portion,
2. a continuous elongated strand of fastener material wound in a coil formation on the hub portion of said spool in engagement with said flange means with a free end section thereof extending outwardly from said coil formation,
3. a housing structure formed of plastic material including (a) means defining an annular space receiving said spool therein, (b) means defining an outlet opening through which said free end section extends with a free end portion of said free end section disposed outwardly of said housing structure and an intermediate portion of said free end section disposed inwardly of said housing structure between said outlet opening and said annular space, (c) means defining guide surfaces engaging said intermediate portion of said free end section between said outlet opening and said annular space, (d) means mounting said spool within said annular space for rotational movement about the axis thereof in response to a longitudinal pull on the free end portion of said strand section and (e) means defining exterior access surfaces cooperable with securing means for mounting said housing structure in operative relation on the portable power operated fastener driving device, and
4. pawl means movably carried by said housing structure adjacent said guide surfaces, said pawl means having surface means disposed in cooperating peripheral engagement with the intermediate strand portion engaged with said guide surfaces for preventing a longitudinal movement of said free end portion in a direction inwardly of said outlet opening by flexed movement into the strand material in response to such movement but permitting a longitudinal movement of said intermediate portion outwardly of said outlet opening in response to a longitudinal pull on said free end portion as aforesaid.

17. A cartridge as defined in claim 16 wherein said flange means comprises a pair of axially spaced annular flange portions extending radially outwardly from opposite ends of said hub portion.

18. A cartridge as defined in claim 17 wherein said continuous elongated strand of fastener material has its opposite end portion connected with said spool in such a way that said opposite end portion is retained against movement away from said spool in response to a pull on the remaining free end portion of said strand after use depletion thereof.

19. A cartridge as defined in claim 18 wherein said housing structure includes a pair of separate cooperating housing parts moved axially together into peripherally interengaged relation and secured therein.

20. A cartridge as defined in claim 19 wherein said pawl means comprises a thin bent plate mounted within an internal socket provided by said housing parts.

21. A cartridge as defined in claim 20 wherein said coil formation rotational mounting means comprises a cylindrical hub portion formed integrally on one of said housing parts centrally within said annular space.

22. A cartridge as defined in claim 21 wherein said spool hub portion includes a hollow hub rotatably engaging said housing hub portion.

23. A cartridge as defined in claim 16 wherein said coil formation rotational mounting means comprises a cylindrical hub portion formed integrally on one of said housing parts centrally within said annular space.

24. A cartridge as defined in claim 23 wherein said spool hub portion includes a hollow hub rotatably engaging said housing hub portion.

25. A cartridge as defined in claim 16 wherein said housing structure includes a pair of separate cooperating housing parts moved axially together into peripherally interengaged relation and secured therein.

26. A cartridge as defined in claim 25 wherein said pawl means comprises a thin bent plate mounted within an internal socket provided by said housing parts.

27. A cartridge as defined in claim 16 wherein said strand of fastener material is a metal wire.

* * * * *